US010667626B2

(12) United States Patent
Abukar

(10) Patent No.: US 10,667,626 B2
(45) Date of Patent: Jun. 2, 2020

(54) PLAY MAT ASSEMBLY

(71) Applicant: Amran Abukar, Willmar, MN (US)

(72) Inventor: Amran Abukar, Willmar, MN (US)

( * ) Notice: Subject to any disclaimer, the term of this patent is extended or adjusted under 35 U.S.C. 154(b) by 0 days.

(21) Appl. No.: 16/166,653

(22) Filed: Oct. 22, 2018

(65) Prior Publication Data

US 2019/0116991 A1 Apr. 25, 2019

Related U.S. Application Data

(60) Provisional application No. 62/576,179, filed on Oct. 24, 2017.

(51) Int. Cl.

| | |
|---|---|
| ***A63H 33/00*** | (2006.01) |
| ***A47D 13/06*** | (2006.01) |
| ***A47D 15/00*** | (2006.01) |
| ***A47D 11/00*** | (2006.01) |
| ***A63H 33/06*** | (2006.01) |
| *A63H 33/10* | (2006.01) |

(52) U.S. Cl.

CPC ..... *A47D 13/06* (2013.01); *A47D 11/00* (2013.01); *A47D 15/003* (2013.01); *A63H 33/008* (2013.01); *A63H 33/067* (2013.01); *A63B 2208/12* (2013.01); *A63H 33/107* (2013.01)

(58) Field of Classification Search

CPC ..... A47D 11/00; A47D 13/06; A47D 15/003; A63H 33/008; A63H 33/107; A63H 33/12; A63H 33/108; A63B 2208/12

USPC ..... 446/118, 122, 123, 227

See application file for complete search history.

(56) References Cited

U.S. PATENT DOCUMENTS 1,230,503 A * 6/1917 Miller ..... A63B 67/06 273/336
2,078,022 A * 4/1937 Roemer ..... A63F 9/088 446/227
2,482,402 A * 9/1949 Corcodilos ..... A63H 33/107 434/403
4,164,091 A * 8/1979 Lin ..... A63H 33/086 446/118
4,543,278 A * 9/1985 Ackerman ..... A63H 33/00 248/205.2
4,971,593 A * 11/1990 Mayhall ..... A63H 3/50 211/70
4,988,322 A * 1/1991 Knudsen ..... A41G 1/007 446/120
5,339,770 A * 8/1994 Haffner ..... A01K 15/025 119/708
5,470,294 A * 11/1995 Ingram ..... A47D 13/04 482/66
5,577,466 A * 11/1996 Luxford ..... A01K 15/025 119/485
5,681,246 A * 10/1997 Dougherty ..... A63B 5/22 482/148

(Continued)

*Primary Examiner* — Joseph B Baldori

(74) *Attorney, Agent, or Firm* — Mueting, Raasch & Gebhardt, P.A.

(57) ABSTRACT

A play mat assembly includes a mat with a first major surface and an opposing second major surface and a plurality of extension coupling points on the first major surface. An extension having a proximal end is removably coupled with one of the plurality of extension coupling points. The extension extends away from the proximal end at the first major surface of the mat to a distal play piece connection point. A play piece is removably coupled with the play piece connection point.

12 Claims, 5 Drawing Sheets

(56) References Cited

U.S. PATENT DOCUMENTS

| | | | | |
|---|---|---|---|---|
| 5,916,006 | A * | 6/1999 | Ganson | A63H 33/00 446/107 |
| 6,315,628 | B1 * | 11/2001 | Quercetti | A63H 33/04 446/103 |
| 6,443,796 | B1 * | 9/2002 | Shackelford | A63H 33/042 273/237 |
| 7,302,724 | B2 * | 12/2007 | Solomon | A47D 15/003 5/417 |
| 7,490,379 | B2 * | 2/2009 | Solomon | A47D 15/003 5/417 |
| 8,628,334 | B2 * | 1/2014 | Kibby | A47D 15/003 434/255 |
| 8,986,012 | B1 * | 3/2015 | McGee | A63H 33/08 434/211 |
| 9,832,975 | B2 * | 12/2017 | Song | A01K 15/024 |
| 9,848,585 | B1 * | 12/2017 | Perozo | A01K 29/00 |
| 10,470,599 | B2 | 11/2019 | Fynbo et al. | |
| 2009/0029330 | A1 * | 1/2009 | Moran | G09B 19/00 434/255 |
| 2009/0253342 | A1 * | 10/2009 | Oren | A47D 5/006 446/227 |

* cited by examiner

PLAY MAT ASSEMBLY

CROSS-REFERENCE TO RELATED APPLICATIONS

This application claims the benefit of U.S. Provisional Application Ser. No. 62/576,179 filed on Oct. 24, 2017, and incorporated here by reference.

FIELD

The present disclosure relates to play mats for children.

BACKGROUND

Playmats for children may provide a convenient and safe play area. Some playmats include arches that allow for toys to be attached in reach of the child. Such arches typically include three or four legs that support the arch, or the arches may be attached to a rigid plastic structure to maintain them upright. The toys may be removably coupled with the arches but typically require the help of an adult and are not removable and/or re-couplable by a young child.

It would be desirable to provide a play mat that is capable of supporting upright extensions. It would also be desirable to provide a play mat that promotes learning by enabling a user to match shapes or colors.

SUMMARY

A play mat assembly includes a mat with a first major surface and an opposing second major surface and a plurality of extension coupling points on the first major surface. An extension having a proximal end is removably coupled with one of the plurality of extension coupling points. The extension extends away from the proximal end at the first major surface of the mat to a distal play piece connection point. A play piece is removably coupled with the play piece connection point.

The extension may be removably coupled with the mat by a support element comprising a connector extending through the mat.

The play mat assembly may include a plurality of extensions including a first type and a second type, and a plurality of play pieces including a first type and a second type. The first type of play piece may be capable of removably coupling with the first type of extension. The second type of play piece may be capable of removably coupling with the second type of extension.

DETAILED DESCRIPTION

The present disclosure relates to play mats for children. In particular, the present disclosure relates to play mats with removably coupled extensions, and play pieces removably coupled with the extensions. The play mats may be constructed to promote learning and recognizing of shapes and colors of various fruit, vegetables, and berries.

The play mat assembly of the present disclosure may include a variety of different play pieces. According to some embodiments, the play pieces may be selectively couplable with certain extensions. The play mat may promote learning by matching play pieces to corresponding extensions and by matching colors.

The term "substantially" as used here has the same meaning as "significantly," and can be understood to modify the term that follows by at least about 75%, at least about 90%, at least about 95%, or at least about 98%. The term "not substantially" as used here has the same meaning as "not significantly," and can be understood to have the inverse meaning of "substantially," i.e., modifying the term that follows by not more than 25%, not more than 10%, not more than 5%, or not more than 2%.

The term "about" is used here in conjunction with numeric values to include normal variations in measurements as expected by persons skilled in the art, and is understood have the same meaning as "approximately" and to cover a typical margin of error, such as ±5% of the stated value.

Terms such as "a," "an," and "the" are not intended to refer to only a singular entity, but include the general class of which a specific example may be used for illustration.

The terms "a," "an," and "the" are used interchangeably with the term "at least one." The phrases "at least one of" and "comprises at least one of" followed by a list refers to any one of the items in the list and any combination of two or more items in the list.

As used here, the term "or" is generally employed in its usual sense including "and/or" unless the content clearly dictates otherwise. The term "and/or" means one or all of the listed elements or a combination of any two or more of the listed elements.

The recitations of numerical ranges by endpoints include all numbers subsumed within that range (e.g., 1 to 5 includes 1, 1.5, 2, 2.75, 3, 3.80, 4, 5, etc. or 10 or less includes 10, 9.4, 7.6, 5, 4.3, 2.9, 1.62, 0.3, etc.). Where a range of values is "up to" or "at least" a particular value, that value is included within the range.

The words "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Figure 1:
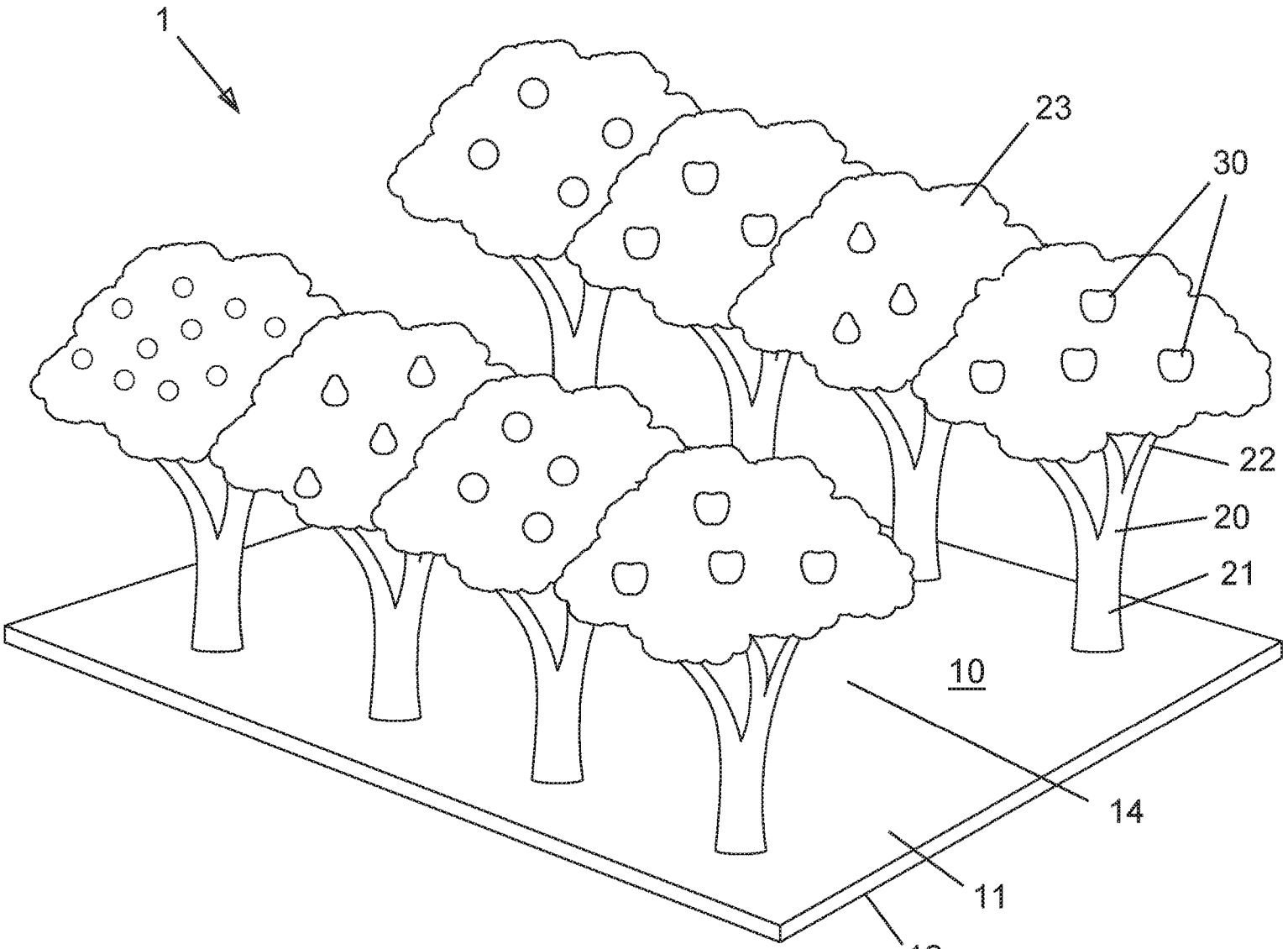
FIG. 1 is a schematic perspective view of a play mat assembly with extensions according to an embodiment.

FIG. 1 shows a schematic perspective view of a play mat assembly 1 according to an embodiment. The play mat assembly 1 includes a mat 10 with a first major surface 11, which may be referred to as a top surface or a play surface, and an opposing second major surface 12, which may be referred to as a bottom surface. In use, the mat 10 is typically placed on the floor or ground (or another generally flat surface) with the second major surface 12 facing down and the first major surface 11 facing up. The play mat assembly 1 also includes one or more extensions 20 that may be removably coupled with the mat 10. The play mat assembly 1 may be used with or without the extensions 20.

The extensions 20 may be removably coupled with the mat 10 at extension coupling points 120. Once coupled, the extensions 20 stand upright and extend away from a proximal end at the first major surface 11 of the mat 10 to a distal play piece connection point 220. The extension 20 may include and be supported by a single stem 21 extending from the mat 10. The extension 20 may include one or more branches 22. One or more of the branches 22 may terminate in an play piece connection point 220. The play piece connection points 220 may be referred to as being "branched," meaning that the play piece connection points 220 extend or branch away from the stem 21 or a branch 22. In some embodiments, branches 22 of adjacent extensions 20 may be connectable with one another. The extension 20 may be constructed to resemble a plant, such as a tree, a shrub, or a fruit or vegetable plant or stem. The extension 20 may further include foliage 23 (e.g., leaves) or other details consistent with the appearance of a plant.

The play mat assembly 1 further includes play pieces 30 removably connectable with the extensions 20. The play pieces 30 may be constructed to resemble fruit or vegetables, although other shapes are also possible. The play mat assembly 1 may include several different types of extensions 20 and several different types of play pieces 30. For example, in a farm-themed or fruit and vegetable-themed play mat assembly 1, each type of extension 20 may correspond to a certain type of plant, such as a fruit tree (e.g., apple tree, pear tree, orange tree, lemon tree, etc.) or a fruit, berry, or vegetable plant (e.g., grape vine, raspberry bush, strawberry plant, banana plant, etc.). Each type of play piece 30 may correspond to a certain type of fruit, berry, or vegetable, corresponding to the types of extensions 20. For example, each play piece 30 may correspond to an apple, pear, orange, lemon, bunch of grapes, raspberry, strawberry, banana, etc. In some embodiments, the extensions 20 and play pieces 30 may be constructed such that each type of play piece 30 can only be coupled with the corresponding type of extension. For example, the extensions 20 and play pieces 30 may be constructed such that an apple can only be coupled with an apple tree, and a banana can only be coupled with a banana plant. In other embodiments of play mat assemblies having a different theme, similarly corresponding extensions and play pieces may be constructed. For example, play pieces of a first type and a second type are couplable with extensions of a first type and a second type, respectively.

Figure 2:
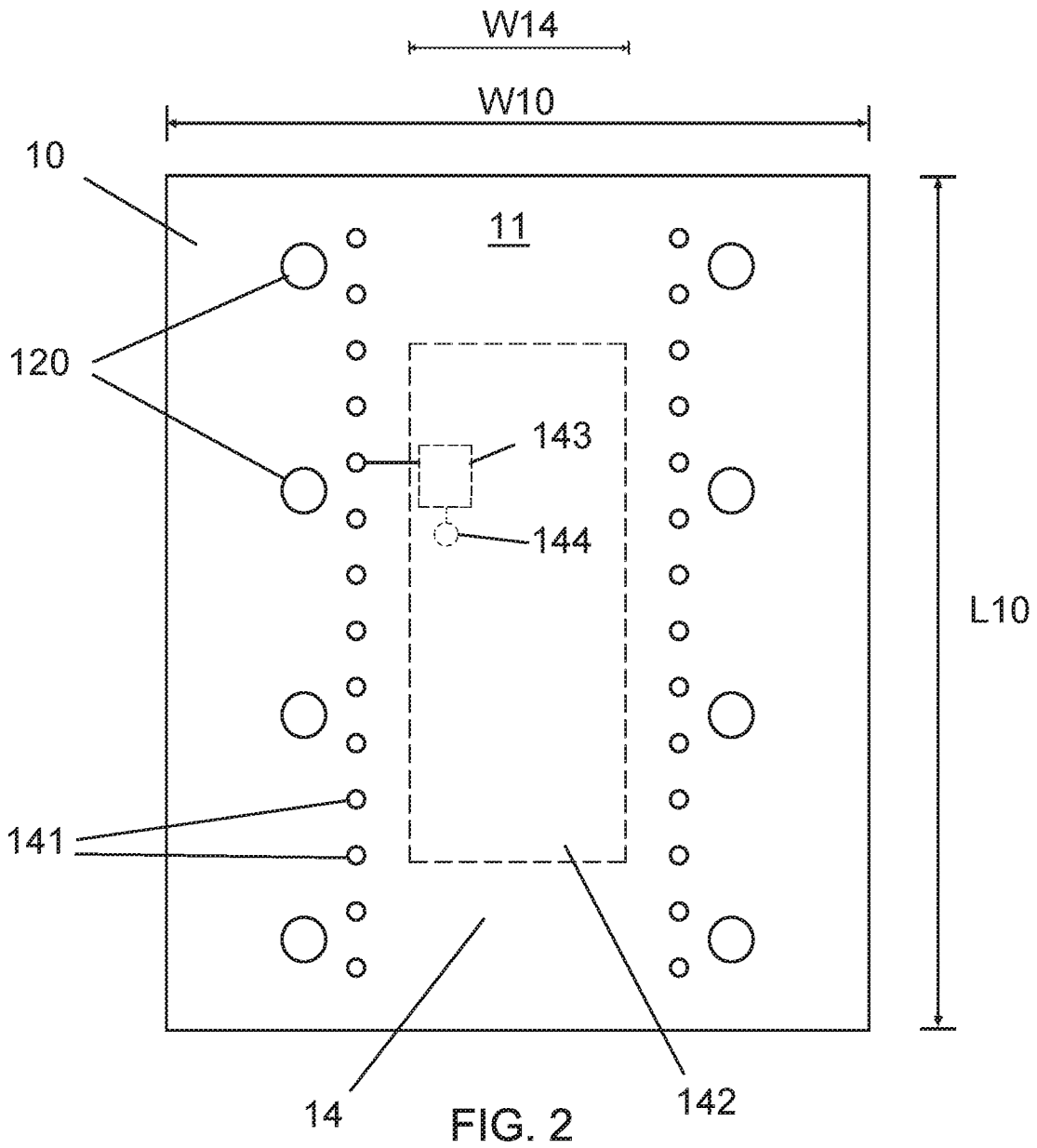
FIG. 2 is a schematic top view of a mat of the play mat assembly in FIG. 1 without the extensions.

A plan view of the mat 10 is shown in FIG. 2. The mat 10 may include one or more extension coupling points 120. The extension coupling points 120 facilitate coupling of the extensions 20 with the mat 10. The extension coupling points 120 may be constructed to accommodate a support element with a coupling mechanism. In some embodiments, the extension coupling points 120 include a through hole extending through the thickness of the mat. The extension coupling points 120 may be reinforced.

The mat 10 may define a play area 14. The extension coupling points 120 may be disposed at any desired location on the mat 10, for example adjacent the play area 14. In one embodiment, the extension coupling points 120 are disposed in a line along one side of the mat 10. The extension coupling points 120 may be disposed in two or more lines. In the example shown, a plurality of extension coupling points 120 are disposed in two substantially parallel lines separated by the play area 14. The play mat assembly 1 may include any desired number of extension coupling points 120 and extensions 20. For example, the mat 10 may have at least 1, at least 2, at least 4, at least 6, or at least 10 extension coupling points 120, or up to 30, up to 25, or up to 20 extension coupling points 120 to facilitate attachment of extensions 20. The play area 14 may have a width W14 that accommodates a user (e.g., a child) sitting, standing, walking, or lying down. In some examples, the play area 14 has a width W14 of at least 10 inches, at least 12 inches, or at least 14 inches, or up to 36 inches, up to 30 inches, or up to 24 inches.

The mat 10 may further comprise one or more lights 141. In some embodiments, the lights 141 are disposed on the first major surface 11 of the mat 10 or are disposed within the mat 10 adjacent or near the first major surface 11. The lights 141 may be oriented to emit light outwardly from the first major surface 11 or through the first major surface 11. Any suitable lights may be used. However, in a preferred embodiment, the lights 141 are LED lights. The lights 141 may be disposed at any desired location on the mat 10. In one embodiment, the lights 141 are disposed in a line adjacent and following the line of extension coupling points 120. In the example shown, a plurality of lights 141 is disposed along the sides of the play area 14.

The mat 10 may include a sensor 142 operatively connected to the one or more lights 141. The sensor 142 may be constructed to sense the presence or an action of a user. For example, the sensor 142 may include a weight sensor, a touch sensor, a motion sensor, a light sensor, or a combination thereof. The sensor 142 may be disposed at any suitable location along the mat 10. In one embodiment, the sensor 142 is disposed in the play area 14. For example, the sensor 142 may be disposed within the mat in the play area 14 such that a user in the play area 14 may trigger the sensor 142.

The mat 10 may further include a loudspeaker 144. The loudspeaker 144 may be configured to play sounds or music. For example, the loudspeaker 144 may be configured to replay sound files stored in a data storage unit.

The mat 10 may further include a control unit 143. The control unit 143 may be operatively connected to the sensor 142 and the light 141 and/or loudspeaker 144, and be configured to activate the light 141 and/or loudspeaker 144 upon receiving a signal from the sensor 142. For example, when the sensor 142 senses weight, touch, motion, or change in light conditions, the sensor may send a signal to the control unit 143 that initiates the activation of the lights and/or playing sounds or music. The control unit 143 may also be constructed and configured to receive a signal from a remote control unit to activate the light and/or loudspeaker. Any suitable control unit 143 may be used, such as a control unit that provides data storage. Examples of suitable control units include microprocessors, Field-Programmable Gate Arrays (FPGA), Digital Signal Processors (DSP), microcontrollers, Application Specific Integrated Circuit (ASIC) state machines, etc. The lights 141, sensor 142, loudspeaker 144, and control unit 143 may be connected to a power source. Any suitable power source may be used, such as a battery.

The mat 10 may have any suitable shape and size. For example, the mat 10 may have a length L10 and/or width W10 of at least 12 inches, at least 18 inches, or at least 24 inches. The mat length L10 and width W10 do not have an upper limit but in reality, mats with a length or width of up to 60 inches, up to 48 inches, or up to 36 inches may be practical. Although a rectangular mat is depicted, the mat 10 may have any suitable shape, including polygonal (e.g., triangle, pentagon, hexagon, star-shaped, etc.) or round or rounded shape (e.g., circular, oval, rounded polygonal shape, etc.), or an irregular shape.

The mat 10 may be made from one continuous piece or may include multiple connectable pieces. In one example, the mat 10 includes multiple pieces that are connectable into a larger mat of a user's desired shape and size. The multiple pieces may be connected by a suitable mechanism, such as, for example, a snap fit, hook and loop connectors, etc. In one embodiment, the mat 10 includes multiple pieces connectable with a puzzle-piece like connection. The mat 10 may be foldable and/or rollable, and is portable.

Figure 3B:
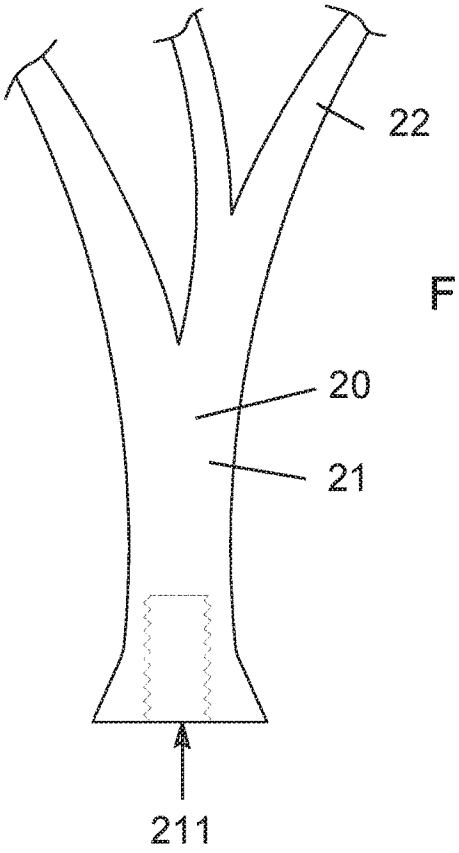
FIG. 3B is a partial side view of an extension for the play mat assembly in FIG. 1.
Figure 3C:
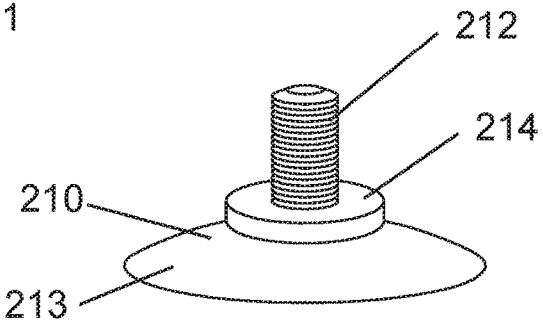
FIG. 3C is a partial side view of a support element for the play mat assembly in FIG. 1.
Figure 3A:
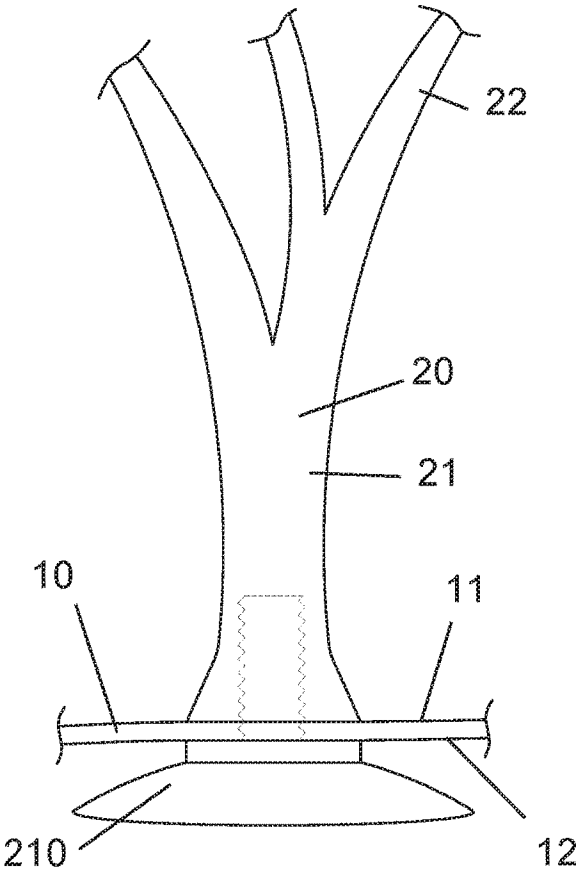
FIG. 3A is a partial side view of the play mat assembly in FIG. 1.

FIGS. 3A-3C show a detailed view of the connection of the extension 20 to the mat 10. Each extension 20 may be removably coupled with the mat 10 by a support element 210 that includes a connector. The connector of the support element 210 may utilize any suitable coupling mechanism, such as a threaded connection, snap fit, interference fit, and the like. The support element 210 may include a connector that couples with the extension 20, for example, with a corresponding connecting feature on the extension 20. In the embodiment shown, the support element 210 includes a threaded connection with a threaded post 212 and the extension 20 includes a corresponding threaded cavity 211. When the extension 20 is coupled with the mat 10, the threaded post 212 extends through the hole of the extension connection point 120 on the mat 10. The corresponding connecting feature of the extension 20 (the threaded cavity 211 in the embodiment shown) engages the threaded post 212 to secure the extension 20 in place. The support element 210 may include a support ring or flange 214 or other stabilizing feature on the side of the second major surface 12 to act as a stopper, to provide a snug fit, and/or to help stabilize the extension 20.

The support element 210 may also include features that help the extension 20 stay in an upright position when coupled with the mat 10 or that may enable fixing the extension 20 in place against an underlying surface, such as the floor. In the embodiment shown, the support element 210 includes a suction cup 213 extending from the connector (the threaded post 212). When the extension 20 and support element 210 are coupled with the mat 10, the suction cup 213 extends downward (e.g., toward a floor) from the second major surface 12.

The support elements 210 may be removable (e.g., may be removed manually and without tools) or may be permanently attached to the mat 10 (e.g., may not be removed without causing damage to the support element 210 or the mat 10).

Figure 4A:
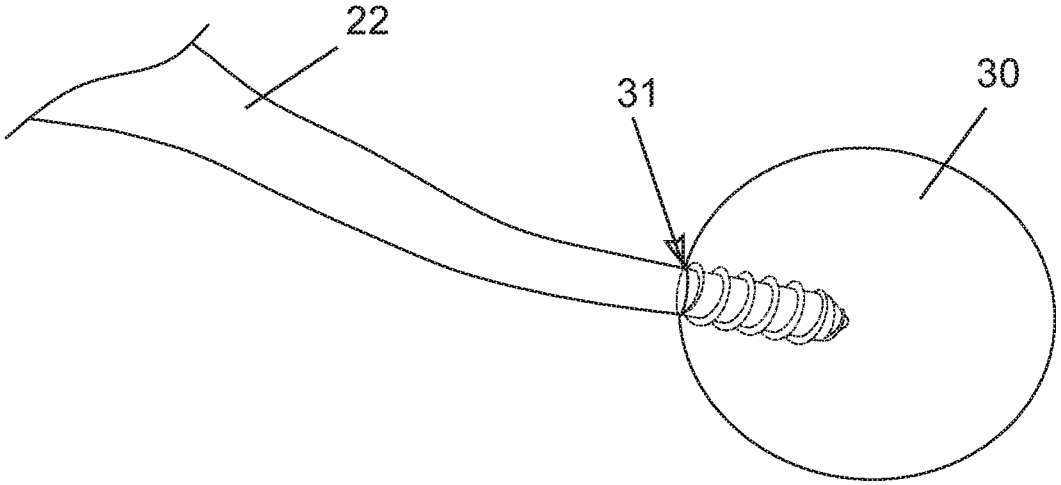
FIG. 4A is a partial view of an extension with a play piece for the play mat assembly in FIG. 1.
Figure 4B:
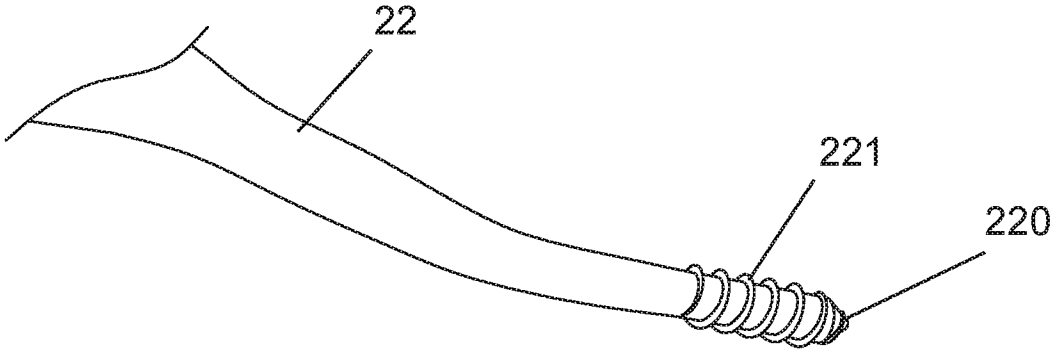
FIG. 4B is a partial view of the extension of FIG. 4A.
Figure 4C:
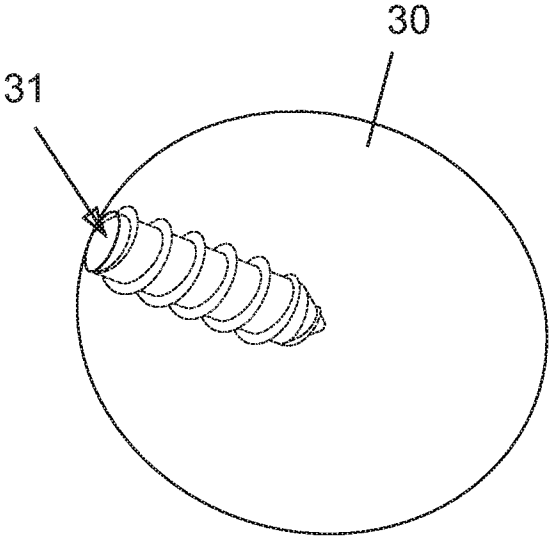
FIG. 4C is a perspective view of the play piece of FIG. 4A.

FIGS. 4A-4C show a detailed view of an exemplary connection of the play piece 30 to the extension 20. Each extension 20 may include one or more branches 22. The branches 22 may terminate in a play piece connection point 220. In a given extension 20, at least one branch 22, at least some branches 22, or each of the branches 22 may terminate in an play piece connection point 220. Thus, an extension 20 may include one or more play piece connection points 220. A single play piece 30 may be removably coupled with each play piece connection point 220. The play piece 30 and the play piece connection point 220 may coupled via a coupling mechanism. Any suitable coupling mechanism can be used, such as a bayonet connection, threaded connection, snap fit, interference fit, hook-and-loop connection, and the like. In the same play mat assembly 1, multiple coupling mechanisms may be used. In some embodiments, the play piece connection point 220 includes a first coupling feature and the play piece 30 includes a corresponding second coupling feature constructed to cooperate with the first coupling feature of the play piece connection point 220. For example, the first coupling feature may include a post or a hook, and the second coupling feature may include a hole or a cavity constructed to accept the post or hook. Alternatively, the features may be reversed. In the embodiment shown, the play piece 30 and the play piece connection point 220 are coupled via threaded connection. The play piece connection point includes threads 221 and the play piece 30 includes a threaded cavity 31.

According to an embodiment, the play mat assembly 1 includes two or more types of extensions 20 and corresponding types of play pieces 30. The types of extensions 20 and play pieces 30 may be coupled by a different coupling mechanism such that only the correct corresponding type of play piece 30 fits onto a given extension 20. For example, an extension 20 having the appearance of a grape vine only accepts play pieces 30 having the corresponding coupling mechanism and the appearance of grapes, and another extension 20 having the appearance of a lemon tree only accepts play pieces 30 having the corresponding coupling mechanism and the appearance of lemons. Coupling mechanisms may differ by type and/or size. In some embodiments, all the coupling mechanisms on a given extension 20 are alike, allowing for play pieces 30 of a single type to be removably coupled with any of the play piece connection points 220 of the extension 20.

Figure 5B:
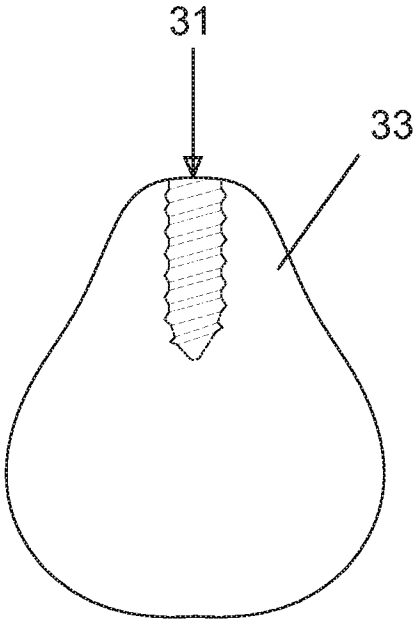
FIGS. 5A and 5B are perspective views of play pieces for the play mat assembly in FIG. 1.
Figure 5A:
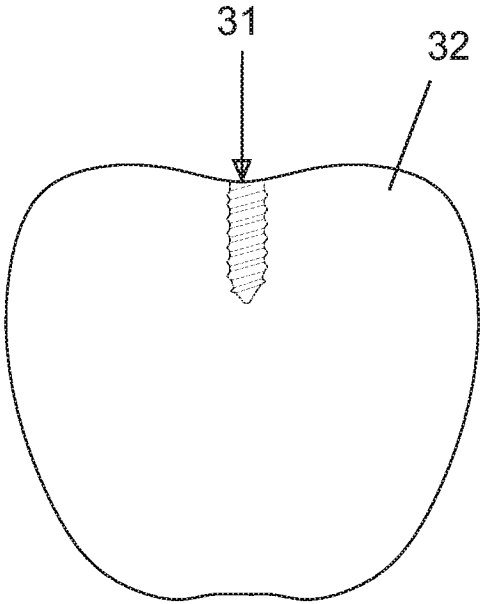

Examples of two different types of play pieces 30 are shown in FIGS. 5A and 5B, resembling an apple 32 and a pear 33, respectively. The play pieces 30 may be colored to match their intended type. The play mat assembly 1 may additionally include other types of play pieces, such as play animals. The additional play pieces may be removably coupled with features of the play mat assembly 1.

The play mat assembly 1 and its parts (e.g., mat 10, extensions 20, play pieces 30, and support elements 210) may be made of any suitable materials. For example, the play mat assembly 1 may include polymeric materials, fabrics, metals, or a combination thereof.

The mat 10 may be made of any suitable material and may be textured, colored, and/or have various images. Preferably, the material and thickness of the mat 10 are such that the mat 10 is capable of supporting the extensions 20 in an upright position. For example, the material and thickness of the mat 10 may be selected to be soft and flexible, yet have sufficient rigidity to be able to support the extensions 20. The mat 10 may be made from a polymeric material, and may include silicone, rubber, plastic, or a combination thereof. The second surface 12 of the mat 10 may include a material with a degree of stickiness that may help prevent slipping yet is easily removable. In one embodiment, the mat 10 is made of silicone. The mat 10 may also include non-polymeric materials. In particular, the lights 141, sensor 142, control unit 143, and power source may include non-polymeric materials. The mat 10 may be colored, textured, and/or have printed imagery. For example, the mat 10 may be colored and/or printed with imagery consistent with the theme of plants, fruit and vegetables, such as grass, other plants, a garden path, dirt, sand, farm equipment, animals, etc. The first major surface 11 of the mat 10 may be textured to provide a tactile experience for the user and/or to enhance the appearance of the surface according with the theme of plants, fruit and vegetables. In some embodiments, the first major surface 11 of the mat 10 includes texture, such as bubbles or dots that provide a soft and comfortable surface for the user.

According to some embodiments, the mat 10 defines a substantially flat piece of material. According to some embodiments, the mat 10 is substantially flat at least in the areas of the extension coupling points 120. The substantially flat piece of material may be textured. According to an embodiment, the extensions 20 are directly connected to extension coupling points 120 of the mat 10 with the aid of a support element 210.

The extensions 20 may be made of any suitable material. For example, the extensions 20 may be made of a polymeric material, such as silicone, rubber, plastic, or a combination thereof. On one hand, the extensions 20 preferably have sufficient rigidity to be able to stand upright. On the other hand, the extensions 20 may be flexible (e.g., stretchy, resilient, pliable, or bendable). For example, the extensions 20 may be made of a material that allows an extension 20 to be temporarily deformed by a user and to return back to its original shape. The extensions 20 may be colored and may each include two or more colors. For example, the extensions 20 may include coloration indicative of a stem of a plant and coloration indicative of leaves. The extensions 20 may include foliage 23. The foliage 23 may be integrally formed with the stem 21 and/or branches 22, or may include separate pieces (e.g., leaves) attached to the stem 21 and/or branches 22.

The play pieces 30 may be made of any suitable material. For example, the play pieces 30 may be made of a polymeric material, such as silicone, rubber, plastic, or a combination thereof. The play pieces 30 are preferably made of a material that is suitable for play and can accommodate the removable connection with the play piece connection points 220 of the extensions 20. In one embodiment, the play pieces 30 include a flexible and/or temporarily deformable material.

In use, a first user (e.g., an adult, parent, teacher, caretaker, or other user) may assemble the play mat assembly 1 for play. For example, the first user may removably couple a desired selection of extensions 20 with the mat 10 by connecting each extension 20 with a support element 30 extending through or from the mat. The first user may also couple play pieces 30 with the extensions 20, or may leave play pieces 30 unattached. In embodiments where the mat 10 is made up of multiple pieces, the first user may arrange pieces in a desired configuration. The first user may set the mat 10 in place by pressing the suction cups 213 against the floor or other surface. A second user (e.g., a child, student, or other user) may select play pieces 30 and may match and couple play pieces 30 with the extensions 20 and/or remove play pieces 30 from the extensions 20. In some embodiments, the second user may need to match play pieces 30 to the type of extension to be able to couple the play pieces 30 with the extensions 20. As the second user uses the play mat assembly 1 (for example, when the second user walks, sits, or stands in the play area 14), the second user may trigger the sensor 142, which may send a signal to the control unit 143 and thus cause the lights 141 to activate. Use of the play mat assembly 1 may promote learning about colors, as well as fruits and vegetables.

The invention claimed is:

1. A play mat assembly comprising:

a mat comprising a first major surface and an opposing second major surface and a plurality of extension coupling points on the first major surface;

a plurality of extensions, each extension having a proximal end removably coupled with one of the plurality of extension coupling points, each extension extending away from the proximal end at the first major surface to a plurality of branched distal play piece connection points;

a plurality of support elements removably coupling the plurality of extensions with the mat, each support element comprising:

a connector comprising a threaded post with a first end and a second end, the threaded post extending through the mat; and a suction cup extending from the second end of the threaded post away from the second major surface; and a plurality of play pieces removably coupled with the play piece connection points, wherein each of the play piece connection points comprises a first coupling feature and each of the play pieces comprises a second coupling feature constructed to mate with the first coupling feature to couple each play piece with each play piece connection point.

2. The play mat assembly of claim 1, wherein the proximal end of the extension comprises a cavity constructed to accept the connector.

3. The play mat assembly of claim 1, wherein each extension is supported by only a single stem extending from the mat.

4. The play mat assembly of claim 1 further comprising a sensor and a control unit operatively connected to the sensor.

5. The play mat assembly of claim 4, wherein the sensor comprises a weight sensor, a touch sensor, a motion sensor, a light sensor, or a combination of two or more thereof.

6. The play mat assembly of claim 4, wherein the sensor is disposed within the mat in a play area between two extension coupling points.

7. The play mat assembly of claim 4 further comprising a light operatively connected to the control unit.

8. The play mat assembly of claim 7, wherein the light is disposed within the mat and is oriented to emit light outwardly through the first major surface.

9. The play mat assembly of claim 7, wherein the control unit is configured to activate the light upon receiving a signal from the sensor.

10. The play mat assembly of claim 4 further comprising a loudspeaker.

11. The play mat assembly of claim 10, wherein the control unit is configured to activate the loudspeaker upon receiving a signal from the sensor.

12. The play mat assembly of claim 1, wherein the plurality of extensions comprises a first type of extension and a second type of extension, and wherein the plurality of play pieces comprises a first type of play piece with a first type of coupling feature capable of removably coupling with the first type of extension only and a second type of play piece with a second type of coupling feature capable of removably coupling with the second type of extension only.

* * * * *